US009272545B2

(12) United States Patent
Shikama et al.

(10) Patent No.: US 9,272,545 B2
(45) Date of Patent: Mar. 1, 2016

(54) RECORDING APPARATUS

(71) Applicant: Brother Kogyo Kabushiki Kaisha, Nagoya-shi, Aichi-ken (JP)

(72) Inventors: Yasuhito Shikama, Nagoya (JP); Kohei Terada, Kiyosu (JP); Shinya Yamamoto, Nagoya (JP); Akihito Kobayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/580,725

(22) Filed: Dec. 23, 2014

(65) Prior Publication Data

US 2015/0183245 A1 Jul. 2, 2015

(30) Foreign Application Priority Data

Dec. 27, 2013 (JP) ..... 2013-271989

(51) Int. Cl.

| | |
|---|---|
| ***B41J 29/38*** | (2006.01) |
| ***B41J 13/00*** | (2006.01) |
| *B41J 3/54* | (2006.01) |
| *B41J 3/60* | (2006.01) |
| *B41J 3/62* | (2006.01) |

(52) U.S. Cl.

CPC ..... *B41J 13/0009* (2013.01); *B41J 3/543* (2013.01); *B41J 3/54* (2013.01); *B41J 3/546* (2013.01); *B41J 3/60* (2013.01); *B41J 3/62* (2013.01)

(58) Field of Classification Search

CPC ..... B41J 3/54; B41J 3/543; B41J 3/546; B41J 3/60; B41J 3/62; B41J 13/009

USPC ..... 347/104

See application file for complete search history.

(56) References Cited

U.S. PATENT DOCUMENTS

| | | | | |
|---|---|---|---|---|
| 6,474,806 | B2 * | 11/2002 | Terauchi et al. | 347/104 |
| 7,192,209 | B2 * | 3/2007 | Otsuka et al. | 400/605 |
| 8,684,487 | B2 * | 4/2014 | Imoto | 347/16 |
| 2009/0001652 | A1 * | 1/2009 | Asada | 271/9.01 |
| 2011/0205320 | A1 * | 8/2011 | Mitsuhashi | B41J 11/002 347/102 |

FOREIGN PATENT DOCUMENTS

| | | |
|---|---|---|
| JP | 2002-302329 | 10/2002 |
| JP | 2005-199541 | 7/2005 |

* cited by examiner

*Primary Examiner* — Lisa M Solomon

(74) *Attorney, Agent, or Firm* — Frommer Lawrence & Haug LLP

(57) ABSTRACT

In a recording apparatus, a first path and a module path of a first recording module for conveying and recording of a recording medium are formed such that a distance between the most downstream ejection opening and a joining position of the first path and a second path is less than a length of a recording medium. The controller executes: a first determination processing for determining whether there is a recording medium which should be conveyed through a join determination position before the recording medium having been supplied to the first recording module; and a wait processing for causing the recording medium having been supplied to the first recording module to wait in a state in which its leading edge is located upstream of the most upstream shared conveyor on the first path, when the controller determines that there is a recording medium.

13 Claims, 11 Drawing Sheets

RECORDING APPARATUS

CROSS REFERENCE TO RELATED APPLICATION

The present application claims priority from Japanese Patent Application No. 2013-271989, which was filed on Dec. 27, 2013, the disclosure of which is herein incorporated by reference in its entirety.

BACKGROUND

1. Technical Field

The present invention relates to a recording apparatus including a plurality of recording modules.

2. Description of the Related Art

There has been known a recording apparatus including a plurality of recording modules. Each of the recording modules includes a head and an individual conveyor. For example, there is known a recording apparatus including three recording modules (i.e., recording portions) arranged vertically. In this recording apparatus, stop portions at which a sheet to be discharged is temporarily stopped are defined downstream of the respective recording portions. In a case where sheets are printed on a page-by-page basis, and printing on a sheet by one of the recording portions is completed earlier than another sheet whose page number is smaller than that of the printed sheet, the printed sheet is stopped at a corresponding one of the stop portions.

SUMMARY

In the above-described recording apparatus, the sheet discharged from each of the recording portions is stopped at a corresponding one of the stop portions, making it possible to consider that each of the stop portions is longer than or equal to the sheet. In this construction, each of the stop portions needs to be longer than or equal to the sheet, resulting in increase in size of the recording apparatus. That is, the construction of the conventional recording apparatus cannot achieve the downsizing of the apparatus.

This invention has been developed to provide a recording apparatus with reduced size.

The present invention provides a recording apparatus including: a plurality of recording modules each including (i) a head formed with a plurality of ejection openings and configured to eject liquid from the plurality of ejection openings and (ii) an individual conveyor configured to convey a recording medium along a module path, the plurality of recording modules including a first recording module and a second recording module different from the first recording module; a receiver configured to receive the recording medium on which recording is performed by any one of the plurality of recording modules; a first path through which the recording medium is to be conveyed from the module path of the first recording module toward the receiver, a second path through which the recording medium is to be conveyed from the module path of the second recording module toward the receiver, the second path including, at a downstream portion thereof, a shared portion extending to the receiver from a joining position at which the first path and the second path merge with each other; at least one shared conveyor configured to convey the recording medium in the shared portion; and a controller configured to control the plurality of recording modules. The controller is configured to store information about a join determination position located upstream of a most upstream shared conveyor of the at least one shared conveyor. The first path and the module path of the first recording module are formed such that a distance between a position opposite a most downstream one of the plurality of ejection openings formed in the first recording module and the joining position along the first path and the module path of the first recording module is less than a length of a specific recording medium along the module path of the first recording module. The specific recording medium is one of recording media receivable in the receiver. The controller is configured to: execute a first determination processing in which the controller determines whether there is a recording medium which should be conveyed through the join determination position before the recording medium having been supplied to the first recording module; and execute a wait processing in which the controller causes the recording medium having been supplied to the first recording module to wait in a state in which the leading edge of the recording medium is located on the first path at a position located upstream of the most upstream shared conveyor, when the controller determines, in the first determination processing, that there is a recording medium which should be conveyed through the join determination position before the recording medium having been supplied to the first recording module.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
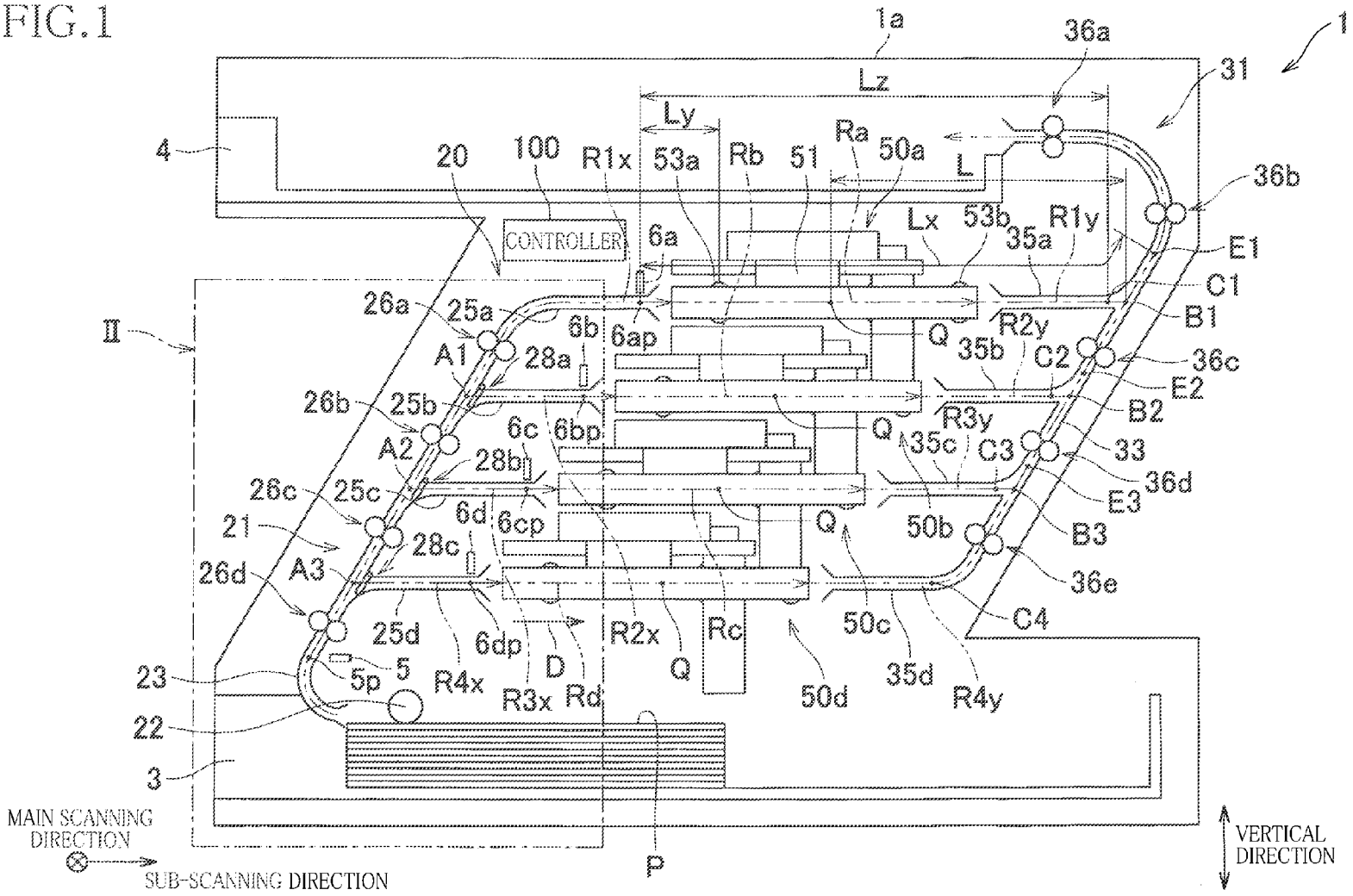
FIG. 1 is a schematic side view illustrating an internal structure of an ink-jet printer according to a first embodiment of the present invention.

Hereinafter, there will be described embodiments of the present invention by reference to the drawings.

First, there will be explained an overall configuration of an ink-jet printer 1 according to a first embodiment of the present invention with reference to FIG. 1.

The printer 1 includes a housing 1*a* having a Z-shape in cross section. Devices and components arranged in the housing 1*a* include recording modules 50*a*-50*d*, a conveying unit 20, a sheet storage 3, a sheet receiver 4, and a controller 100.

The recording modules 50*a*-50*d* are arranged in the vertical direction. A recording module 50*a* is the farthest from the sheet storage 3 and the nearest to the sheet receiver 4 among the recording modules 50*a*-50*d*. The recording module 50*d* is the nearest to the sheet storage 3 and the farthest from the sheet receiver 4 among the recording modules 50*a*-50*d*.

The recording modules 50*a*-50*d* have the same construction and each includes a head 51. Four cartridges, not shown, are mountable on and removable from the housing 1*a*. Each of the cartridges stores black ink and is connected to a corresponding one of the heads 51 by a tube and a pump. The controller 100 drives the pump to supply the ink from the cartridge to the head 51 through the tube.

The conveying unit 20 is configured to convey a sheet P as one example of a recording medium from the sheet storage 3 to the sheet receiver 4 via any one of the module paths Ra-Rd formed in the respective recording modules 50*a*-50*d*. The conveying unit 20 includes an upstream unit 21 and a downstream unit 31. The upstream unit 21 has paths R1*x*-R4*x* through which the sheet P is conveyed from the sheet storage 3 to the respective module paths Ra-Rd. The downstream unit 31 has paths R1*y*-R4*y* through which the sheet P is conveyed from the downstream end portions of the respective module paths Ra-Rd to the sheet receiver 4.

The paths R1*x*-R4*x* extend from the sheet storage 3 to the respective upstream end portions of the module paths Ra-Rd. The paths R1*x*, R2*x* extend from the sheet storage 3 to a branch position A1 by the same route and branch off at the branch position A1 so as to extend to the module paths Ra, Rb, respectively. The paths R2*x*, R3*x* extend from the sheet storage 3 to a branch position A2 by the same route and branch off at the branch position A2 so as to extend to the module paths Rb, Rc, respectively. The paths R3*x*, R4*x* extend from the sheet storage 3 to a branch position A3 by the same route and branch off at the branch position A3 so as to extend to the module paths Rc, Rd, respectively.

The upstream unit 21 includes a sheet-supply roller 22, roller pairs 26*a*-26*d*, guides 23, 25*a*-25*d*, and switchers 28*a*-28*c*.

The sheet-supply roller 22 is disposed so as to contact an uppermost one of the sheets P stored in the sheet storage 3. The controller 100 drives a sheet-supply motor 22M (see FIG. 6) to rotate the sheet-supply roller 22. This rotation supplies the uppermost sheet P from the sheet storage 3.

Each of the roller pairs 26*a*-26*d* has two rollers contacting each other and conveys the sheet P, with the two rollers nipping the sheet P therebetween. One of the two rollers of each of the roller pairs 26*a*-26*d* is a drive roller which is rotated by an upstream conveying motor 26M (see FIG. 6) driven by the controller 100. The other of the two rollers of each of the roller pairs 26*a*-26*d* is a driven roller which is rotated, in a direction reverse to a direction of the rotation of the drive roller, by the rotation of the drive roller while contacting the drive roller. As a result, the sheet P supplied by the sheet-supply roller 22 from the sheet storage 3 is conveyed to any one of the module paths Ra-Rd. The roller pairs 26*a*-26*d* are driven in synchronization with each other by the upstream conveying motor 26M.

Each of the guides 23, 25*a*-25*d* defines a corresponding one or ones of the paths R1*x*-R4*x* and includes a pair of plates arranged spaced apart from each other. The guides 25*a*-25*d* extend in the horizontal direction and define the respective downstream portions of the paths R1*x*-R4*x*. The guide 23 extends obliquely with respect to the vertical direction and defines the upstream portions of the respective paths R1*x*-R4*x*. The guide 25*a* is connected to the other end portion of the guide 23 from the sheet storage 3, and the guides 25*b*-25*d* are connected to the guide 23 other than its end portions.

The switchers 28*a*-28*c* are respectively arranged at the branch positions A1-A3. The switcher 28*a* at the branch position A1 switches a destination of the sheet P between the path R1*x* and the path R2*x*. The switcher 28*b* at the branch position A2 switches a destination of the sheet P between one of the paths R1*x*, R2*x* and the path R3*x*. The switcher 28*c* at the branch position A3 switches a destination of the sheet P between one of the paths R1*x*-R3*x* and the path R4*x*.

Figure 2:
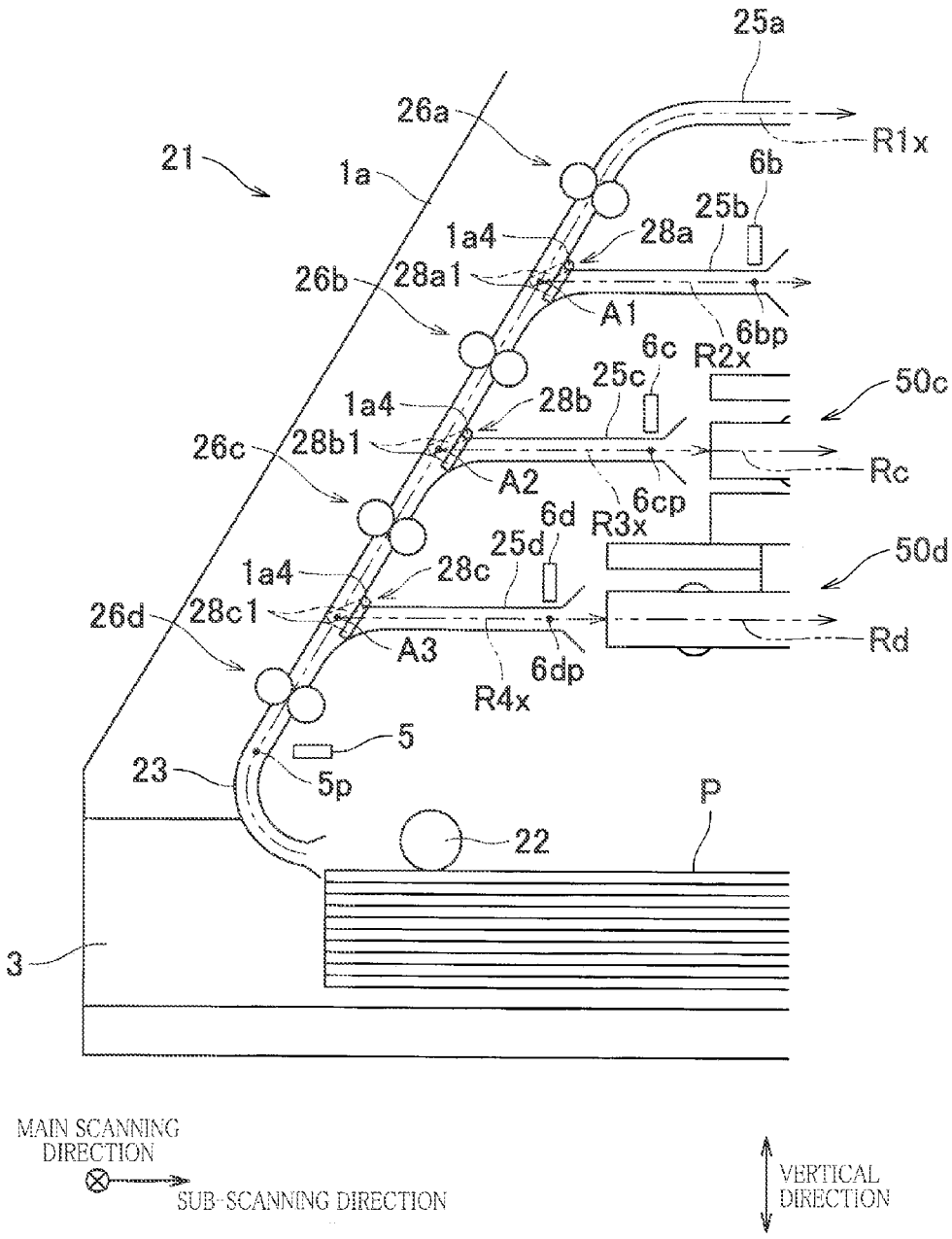
FIG. 2 is an enlarged view of the area II illustrated in FIG. 1.
Figure 6:
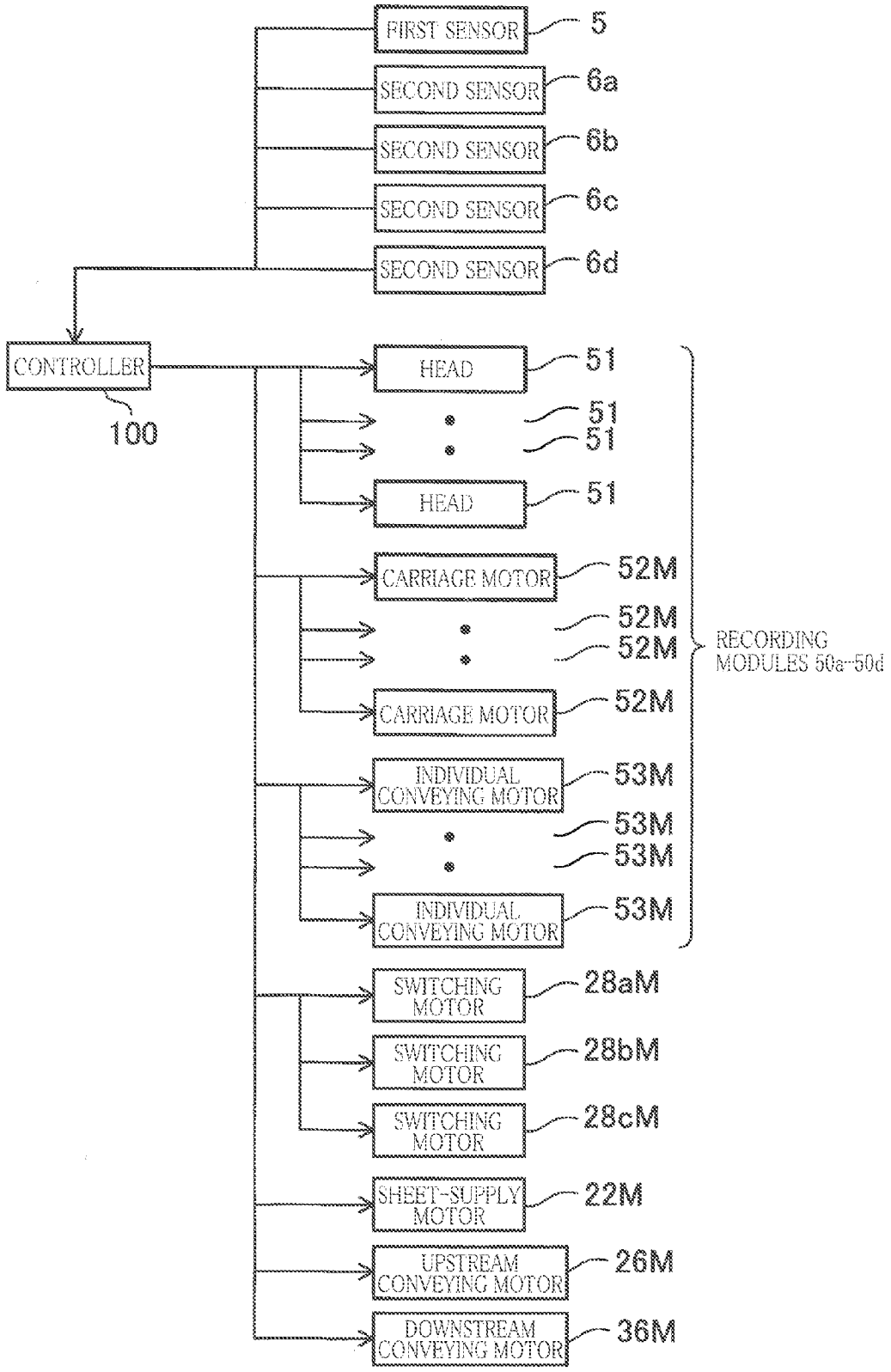
FIG. 6 is a block diagram illustrating an electric configuration of the printer illustrated in FIG. 1.

The switchers 28*a*-28*c* respectively include pivot members 28*a*1-28*c*1 (see FIG. 2) and switching motors 28*a*M-28*c*M (see FIG. 6). Each of the pivot members 28*a*1-28*c*1 is pivotable about a corresponding one of pins 1*a*4 provided in the housing 1*a*. The controller 100 drives each of the switching motors 28*a*M-28*c*M to switch a position of a corresponding one of the pivot members 28*a*1-28*c*1 between a first position indicated by solid lines in FIG. 2 and a second position indicated by broken lines in FIG. 2. At the first position, a distal end of each of the pivot members 28*a*1-28*c*1 is held in contact with the corresponding one of the guide 25*b*, 25*c*, 25*d*. At the second position, the distal end of each of the pivot members 28*a*1-28*c*1 is held in contact with the guide 23.

When the pivot member 28*a*1 is located at the first position, the path R1*x* is opened, and the path R2*x* is closed at the branch position A1. Accordingly, the sheet P having been conveyed from the sheet storage 3 to the branch portion A1 is conveyed to the module path Ra along the path R1*x*. When the pivot member 28*a*1 is located at the second position, the path R1*x* is closed, and the path R2*x* is opened at the branch position A1. Accordingly, the sheet P having been conveyed from the sheet storage 3 to the branch portion A1 is conveyed to the module path Rb along the path R2*x*.

When the pivot member 28*b*1 is located at the first position, the paths R1*x*, R2*x* are opened, and the path R3*x* is closed at the branch position A2. Accordingly, the sheet P having been conveyed from the sheet storage 3 to the branch portion A2 is conveyed to the branch position A1 along the shared portion of the paths R1*x*, R2*x*. When the pivot member 28*b*1 is located at the second position, the paths R1*x*, R2*x* are closed, and the path R3*x* is opened at the branch position A2. Accordingly, the sheet P having been conveyed from the sheet storage 3 to the branch portion A2 is conveyed to the module path Rc along the path R3*x*.

When the pivot member 28*c*1 is located at the first position, the paths R1*x*-R3*x* are opened, and the path R4*x* is closed at the branch position A3. Accordingly, the sheet P having been conveyed from the sheet storage 3 to the branch portion A3 is conveyed to the branch position A2 along the shared portion of the paths R1*x*-R3*x*. When the pivot member 28*c*1 is located at the second position, the paths R1*x*-R3*x* are closed, and the path R4*x* is opened at the branch position A3. Accordingly, the sheet P having been conveyed from the sheet storage 3 to the branch portion A3 is conveyed to the module path Rd along the path R4*x*.

A first sensor 5 is disposed between the sheet-supply roller 22 and the roller pair 26*d* at a position opposite the shared portion of the paths R1*x*-R4*x*. Second sensors 6*a*-6*d* are disposed opposite the respective downstream end portions of the paths R1*x*-R4*x*.

Each of the first sensor 5 and the second sensors 6*a*-6*d* is configured to output a signal indicating the presence or absence of the sheet P at a corresponding one of a first sensing position 5*p* and second sensing positions 6*ap*-6*dp*. Each of the first sensor 5 and the second sensors 6*a*-6*d* outputs an ON signal when there is a sheet P at the corresponding position, and outputs an OFF signal when there is no sheet P at the corresponding position. The first sensing position 5*p* is determined at a position near the shared portion of the paths R1*x*-R4*x* between the sheet-supply roller 22 and the roller pair 26*d*. Each of the second sensing positions 6*ap*-6*dp* is determined at a position near a corresponding one of the respective downstream end portions of the paths R1*x*-R4*x*. In other words, the second sensing positions 6*ap*-6*dp* are respectively determined at a position on the path R1*x* which is located downstream of the branch position A1, a position on the path R2*x* which is located downstream of the branch position A1, a position on the path R3*x* which is located downstream of the branch position A2, and a position on the path R4*x* which is located downstream of the branch position A3.

Each of the sensors 5, 6*a*-6*d* includes an ON counter and an OFF counter. When an ON signal is output, the ON counter produces a counter pulse which is proportional to an amount of rotation of the upstream conveying motor 26M and starts counting the number of pulses, and when another ON signal is thereafter output, the ON counter resets the count. When an OFF signal is output, the OFF counter produces a counter pulse which is proportional to an amount of rotation of the upstream conveying motor 26M and starts counting the number of pulses, and when another OFF signal is thereafter output, the OFF counter resets the count. Count data created by the ON counter represents an amount of conveyance of the sheet P from the timing when the leading edge of the sheet P has reached a sensing position of a corresponding one of the sensors 5, 6*a*-6*d*. Count data created by the OFF counter represents an amount of conveyance of the sheet P from the timing when the trailing edge of the sheet P has reached the sensing position of the corresponding one of the sensors 5, 6*a*-6*d*.

The paths R1*y*-R4*y* extend from the respective downstream end portions of the module paths Ra-Rd to the sheet receiver 4. The paths R1*y*, R2*y* extend from the respective downstream end portions of the module paths Ra, Rb, then merge with each other at a joining position B1, and extend from the joining position B1 to the sheet receiver 4 by the same route. The paths R2*y*, R3*y* extend from the respective downstream end portions of the module paths Rb, Rc, then merge with each other at a joining position B2, and extend from the joining position B2 to the sheet receiver 4 by the same route. The paths R3*y*, R4*y* extend from the respective downstream end portions of the module paths Rc, Rd, then merge with each other at a joining position B3, and extend from the joining position B3 to the sheet receiver 4 by the same route.

In the present embodiment, it is possible to assume, as a first assumption, that the recording module 50*a* corresponds to a first recording module, a recording module 50*b* to a second recording module, the path R1*y* to a first path, a path R2*y* to a second path, and the joining position B1 to a joining position. In the first assumption, the path R2*y* has, at its downstream portion, a shared portion shared with the path R1*y* (which extends from the joining position B1 to the sheet receiver 4), and the path R2*y* merges with the path R1*y* at the joining position B1 provided on an end portion of the shared portion. In the first assumption, roller pairs 36*a*, 36*b* serve as a shared conveyor, and the roller pair 36*b* as a most upstream shared conveyor. In the first assumption, a join determination position E1 is determined on the shared portion of the paths R1*y*, R2*y* at a position between the joining position B1 and the roller pair 36*b*. Alternatively, in the present embodiment, it is possible to assume, as a second assumption, that the recording module 50*b* corresponds to the first recording module, the recording module 50*c* to the second recording module, the path R2*y* to the first path, the path R3*y* to the second path, and the joining position B2 to the joining position. In the second assumption, the path R3*y* has, at its downstream portion, a shared portion shared with the path R2*y* (which extends from the joining position B2 to the sheet receiver 4), and the path R3*y* merges with the path R2*y* at the joining position B2 provided on an end portion of the shared portion. In the second assumption, the roller pairs 36*a*, 36*b* and a roller pair 36*c* serve as the shared conveyor, and the roller pair 36*c* as the most upstream shared conveyor. In the second assumption, a join determination position E2 is determined on the shared portion of the paths R2*y*, R3*y* at a position between the joining position B2 and the roller pair 36*c*. Alternatively, in the present embodiment, it is possible to assume, as a third assumption, that the recording module 50*c* corresponds to the first recording module, the recording module 50*d* to the second recording module, the path R3*y* to the first path, the path R4*y* to the second path, and the joining position B3 to the joining position. In the third assumption, the path R4*y* has, at its downstream portion, a shared portion shared with the path R3*y* (which extends from the joining position B3 to the sheet receiver 4), and the path R4*y* merges with the path R3*y* at the joining position B3 provided on an end portion of the shared portion. In the third assumption, the roller pairs 36*a*-36*c* and a roller pair 36*d* serve as the shared conveyor, and the roller pair 36*d* as the most upstream shared conveyor. In the third assumption, a join determination position E3 is determined on the shared portion of the paths R3*y*, R4*y* at a position between the joining position B3 and the roller pair 36*d*.

As illustrated in FIG. 1, the first path and the module path of the first recording module (e.g., the path R1*y* and the module path Ra) are formed such that a distance L along the first path and the module path between (i) a position Q opposite the most downstream one of a multiplicity of ejection openings 51*b* (see FIG. 3) of the first recording module (e.g., the recording module 50*a*) and (ii) the joining position (e.g., the joining position B1) is shorter than the length of the sheet P of the A4 size or the letter size. The condition for the distance L is established for each of the recording modules 50*a*-50*c*. That is, each of a distance along the path R2*y* and the module path Rb between a position Q opposite the most downstream one of a multiplicity of ejection openings 51*b* of the recording module 50*b* and the joining position B2 and a distance along the path R3*y* and the module path Rc between a position Q opposite the most downstream one of a multiplicity of ejection openings 51*b* of the recording module 50*c* and the joining position B3 is also shorter than the length of the sheet P of the A4 size or the letter size.

The downstream unit 31 includes the roller pairs 36*a*-36*d*, a roller pair 36*e*, and guides 33, 35*a*-35*d*.

Each of the roller pairs 36*a*-36*e* has two rollers contacting each other and conveys the sheet P, with the two rollers nipping the sheet P therebetween. One of the two rollers of each of the roller pairs 36*a*-36*e* is a drive roller which is rotated by a downstream conveying motor 36M (see FIG. 6) driven by the controller 100. The other of the two rollers of each of the roller pairs 36*a*-36*e* is a driven roller which is rotated, in a direction reverse to a direction of the rotation of the drive roller, by the rotation of the drive roller while contacting the drive roller. As a result, the sheet P conveyed from any of the module paths Ra-Rd is conveyed to the sheet receiver 4. The roller pairs 36*a*-36*e* are driven in synchronization with each other by the downstream conveying motor 36M.

Each of the guides 33, 35*a*-35*d* defines a corresponding one or ones of the paths R1*y*-R4*y* and includes a pair of plates arranged spaced apart from each other. The guides 35*a*-35*d* extend in the horizontal direction and define the respective upstream portions of the paths R1*y*-R4*y*. The guide 33 extends obliquely with respect to the vertical direction and defines the downstream portions of the respective paths R1*y*-R4*y*. The guide 35*d* is connected to the other end portion of the guide 33 from the sheet receiver 4, and the guides 35*a*-35*c* are connected to the guide 33 other than its end portions.

Each of the sheet storage 3 and the sheet receiver 4 is mountable on and removable from the housing 1*a* in a sub-scanning direction. The sheet storage 3 is a tray opening upward and can store a plurality of sheets P. The sheet receiver 4 is a tray opening upward and can receive or support a plurality of sheets P. Each of the sheet storage 3 and the sheet receiver 4 can store or receive the sheets P of various sizes including the postcard size, the A6 size, the A4 size, the letter size, and the A3 size.

In the present embodiment, the sheet P of the A4 size or the letter size is one example of a specific recording medium. Also, the length of the sheet P (i.e., the length of the sheet P in a direction D along the module paths Ra-Rd) is one example of the length of the recording medium.

The sub-scanning direction is parallel with the horizontal plane and parallel with the respective downstream portions of the paths R1*x*-R4*x*, the module paths Ra-Rd, and the respective upstream portions of the paths R1*y*-R4*y*. A main scanning direction is a direction parallel with the horizontal plane and perpendicular to the sub-scanning direction. The vertical direction is perpendicular to the sub-scanning direction and the main scanning direction.

The controller 100 includes a central processing unit (CPU) as a computing device, a read only memory (ROM), a random access memory (RAM) including a non-transitory RAM, an application specific integrated circuit (ASIC), an interface (I/F), and an input/output port (110). The ROM stores programs to be executed by the CPU, various kinds of fixed data (including information relating the join determination positions E1-E3), and other similar data. The RAM temporarily stores data necessary for execution of the programs, such as image data, count data of various counters, and various control flags. The ASIC executes rewriting and sorting of image data and other processings such as a signal processing and an image processing. The interface transmits and receives data to and from an external device such as a PC connected to the printer 1. The input/output port inputs and outputs signals produced by various sensors.

Figure 3:
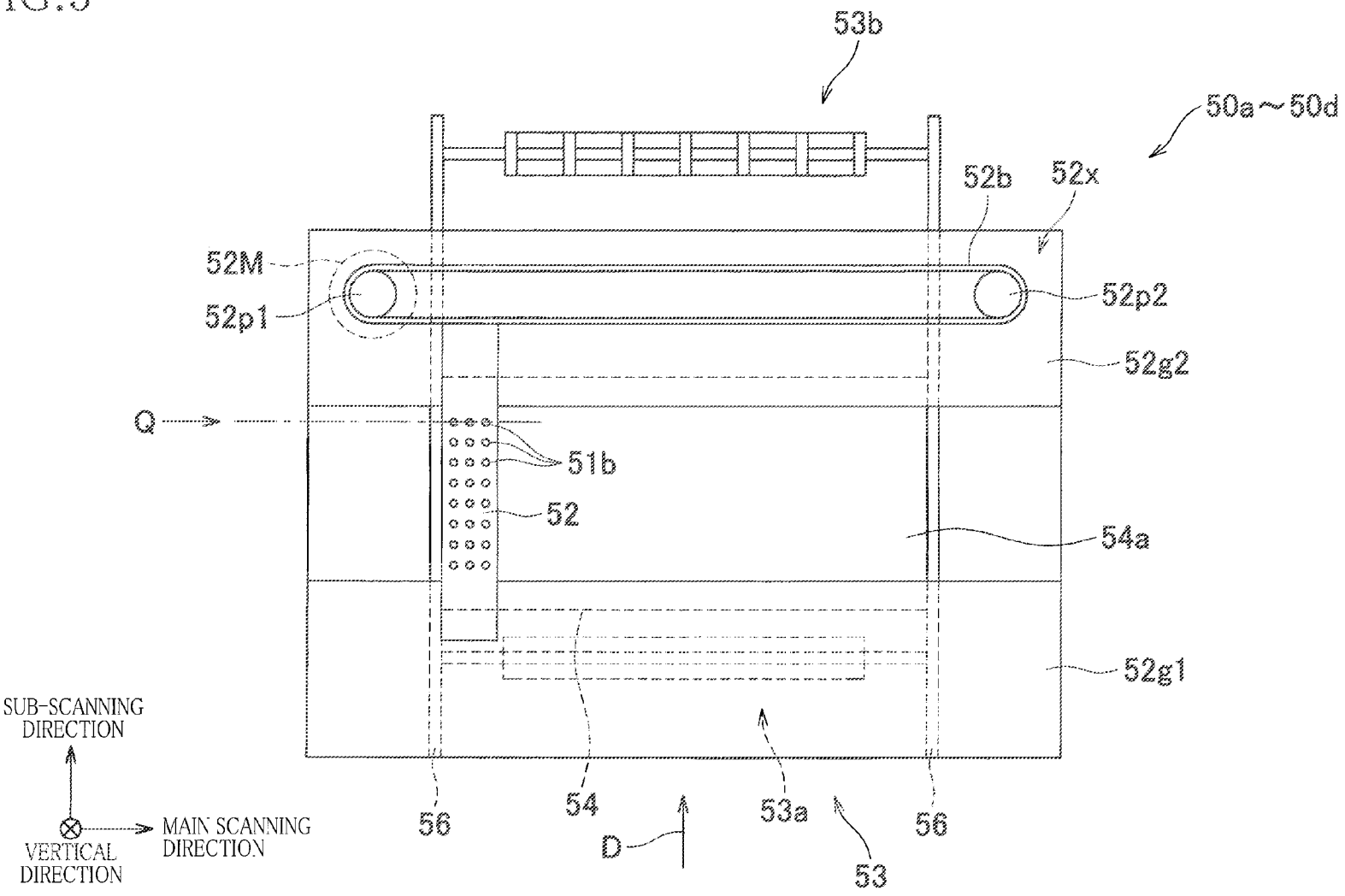
FIG. 3 is a plan view of a recording module of the printer illustrated in FIG. 1.
Figure 4:
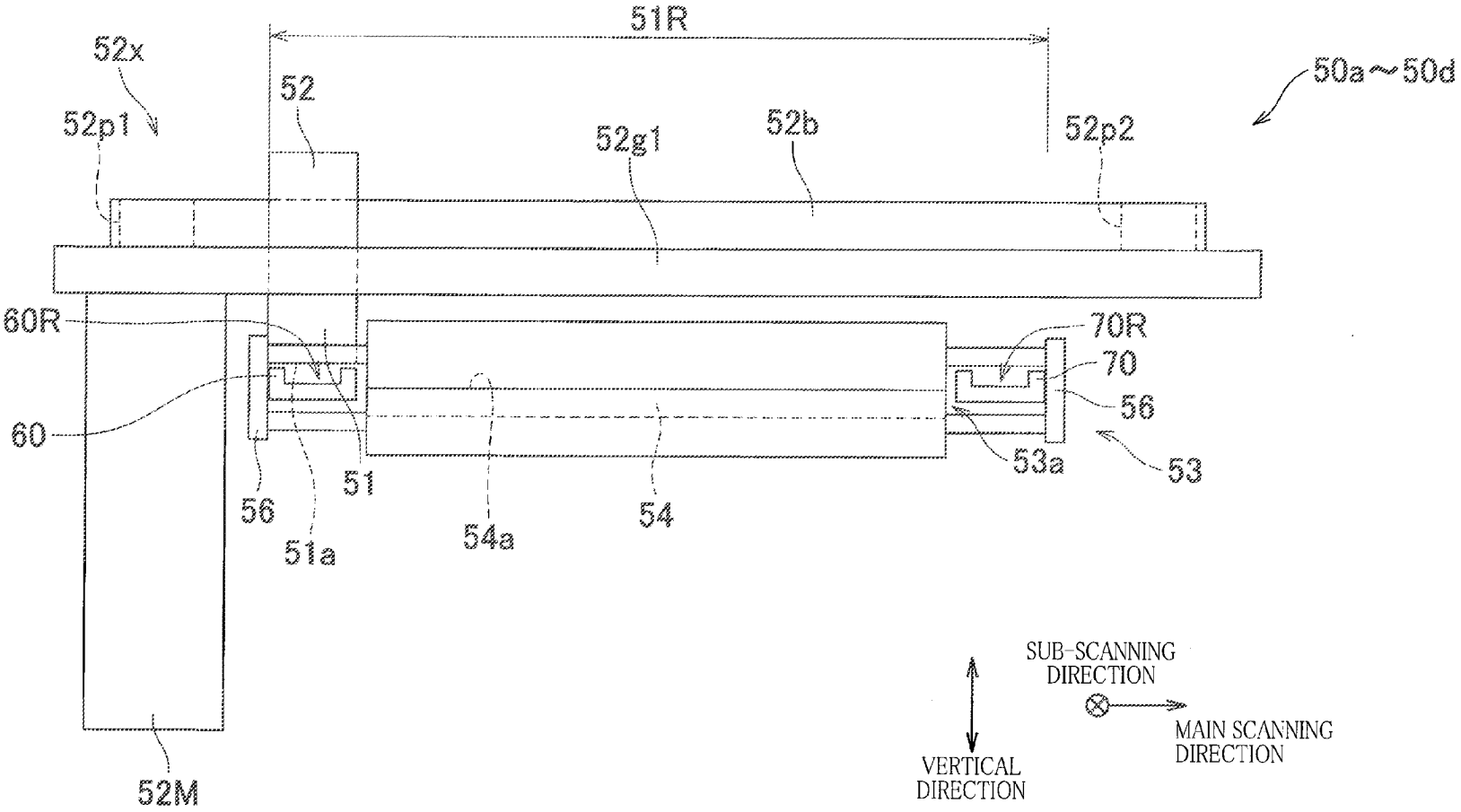
FIG. 4 is a front elevational view of the recording module of the printer illustrated in FIG. 1.
Figure 5:
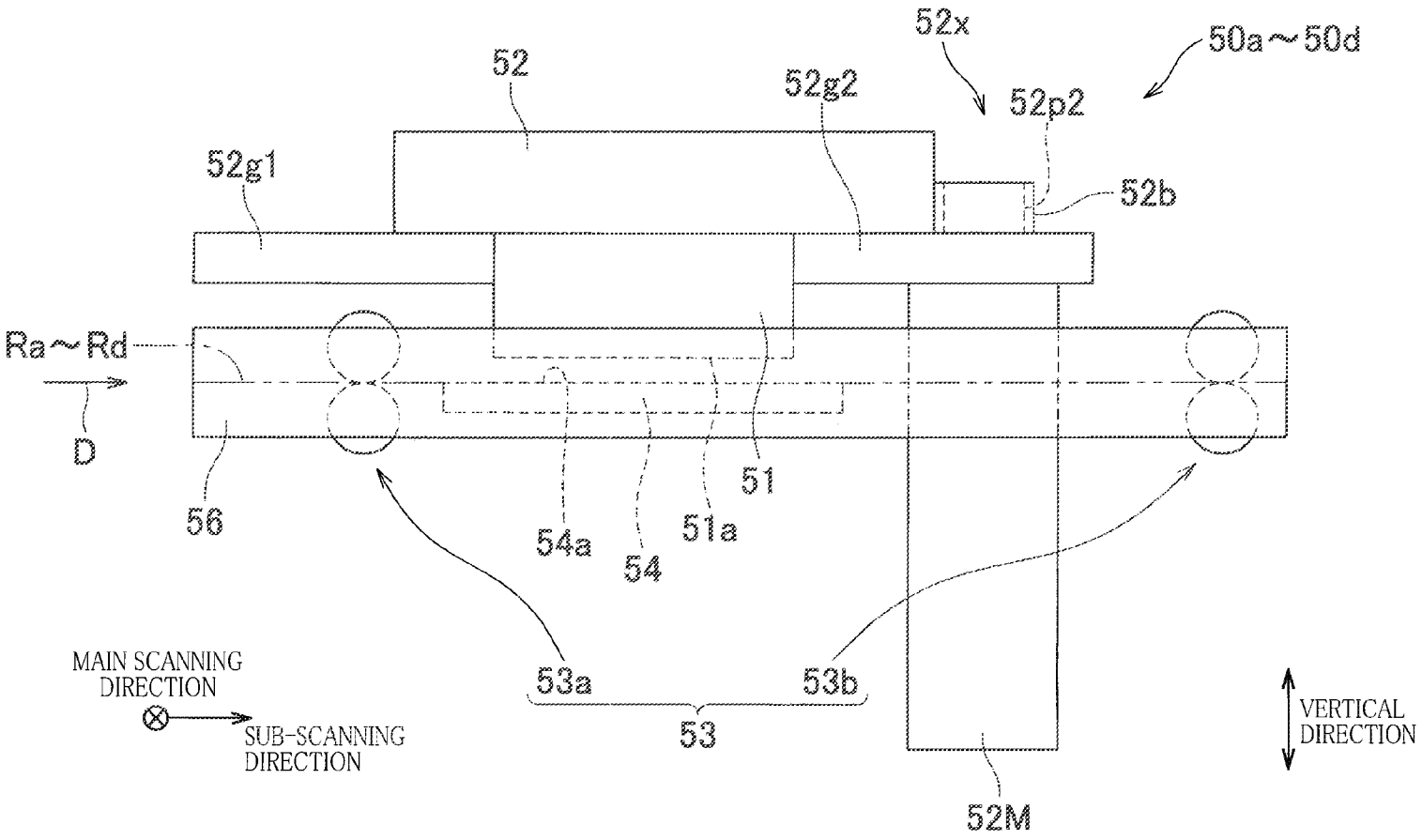
FIG. 5 is a side view of the recording module of the printer illustrated in FIG. 1.

There will be next explained the recording modules 50*a*-50*d* with reference to FIGS. 3-5.

Each of the recording modules 50*a*-50*d* includes the head 51, a carriage 52, and an individual conveyor 53.

The head 51 is a serial head having a generally rectangular parallelepiped shape and supported by the housing 1*a* via the carriage 52. An upper surface of the head 51 is fixed to the carriage 52. A lower surface of the head 51 is an ejection surface 51*a* having the plurality of ejection openings 51*b* opening therein.

The carriage 52 is reciprocable in the main scanning direction by a carriage moving device 52*x*. The carriage 52 supports the head 51 and reciprocates the head 51 in the main scanning direction within a head movable region 51R (see FIG. 4). The carriage moving device 52*x* includes guides 52*g*1, 52*g*2, pulleys 52*p*1, 52*p*2, a belt 52*b*, and a carriage motor 52M. Each of the guides 52*g*1, 52*g*2 has a rectangular shape when viewed in the vertical direction, and the guides 52*g*1, 52*g*2 are spaced apart from each other in the sub-scanning direction. An upper portion of the head 51 is interposed between the guides 52*g*1, 52*g*2 which respectively support opposite ends of the carriage 52 in the sub-scanning direction such that the carriage 52 is slidable in the main scanning direction. The pulleys 52*p*1, 52*p*2 are rotatably supported by opposite end portions of the guide 52*g*2 in the main scanning direction. The pulleys 52*p*1, 52*p*2 have the same diameter and are arranged at the same position in the sub-scanning direction. The belt 52*b* is an endless belt looped over the pulleys 52*p*1, 52*p*2 and travels by the rotation of the pulleys 52*p*1, 52*p*2. The carriage 52 is fixed to the belt 52*b*. The carriage motor 52M has a circular cylindrical shape elongated in the vertical direction and is fixed to a lower surface of the guide 52*g*2. A rotation shaft of the carriage motor 52M is mounted on the pulley 52*p*1 so as to extend in the vertical direction.

The pulley 52*p*1 is a drive pulley which is rotated forwardly and reversely by the carriage motor 52M driven by the controller 100. The rotation of the pulley 52*p*1 rotates the belt 52*b*. The pulley 52*p*2 is a driven pulley which is rotated by the rotation of the belt 52*b*. With the operations of the components and devices of the carriage moving device 52*x*, the carriage 52 supporting the head 51 is reciprocated in the main scanning direction. During this reciprocation, the controller 100 controls the head 51 to eject the ink from the ejection openings 51*b* at desired timings to record an image on the sheet P.

Each of the individual conveyors 53 is configured to intermittently convey the sheet P along the corresponding one of the module paths Ra-Rd in the direction D and includes roller pairs 53*a*, 53*b* and an individual conveying motor 53M (see FIG. 6). The roller pairs 53*a*, 53*b* are rotated by the individual conveying motor 53M driven by the controller 100. This rotation conveys the sheet P in the direction D. The direction D is a direction parallel with the sub-scanning direction and directed from an upstream side to a downstream side of each of the module paths Ra-Rd. That is, the direction D is a direction in which the sheet P is conveyed when an image is recorded on the sheet P. The roller pairs 53*a*, 53*b* extend in the main scanning direction and interpose the head 51 in the sub-scanning direction. That is, in each of the module paths Ra-Rd, the roller pair 53*a* is disposed upstream of the head 51, and the roller pair 53*b* is disposed downstream of the head 51.

In the present embodiment, the sub-scanning direction is one example of a first direction, and the direction D is one example of a second direction.

A platen 54 is disposed between the roller pairs 53*a*, 53*b* at a position opposite the ejection surface 51*a*. The platen 54 has a flat upper surface 54*a* which can support a lower surface of the sheet P. A space appropriate for recording is formed between the ejection surface 51*a* and the upper surface 54*a*.

The roller pairs 53*a*, 53*b* and the platen 54 are supported by a pair of flanges 56. The pair of flanges 56 extending in the sub-scanning direction are spaced apart from each other in the main scanning direction.

An upper one of two rollers of the roller pair 53*b* is a spur roller provided with a plurality of spurs, in order not to deteriorate the image recorded on the sheet P when the roller pair 53*b* nips the sheet P.

The controller 100 controls each of the recording modules 50*a*-50*d* to perform (i) an intermittently conveying operation in which the sheet P is intermittently conveyed in the direction D by the corresponding individual conveyor 53 based on signals output from a corresponding one of the second sensors 6*a*-6*d* and image data contained in a recording command and (ii) a reciprocating operation in which, during a conveyance stopped period in which the sheet P is stopped in the intermittently conveying operation, the ink is ejected from the ejection openings 51*b* while the carriage 52 is reciprocated in the main scanning direction. Specifically, the controller 100 starts recording by performing the intermittently conveying operation and the reciprocating operation when an amount of conveyance of the sheet P from the point in time when the leading edge of the sheet P has reached the corresponding one of the second sensing positions 6*ap*-6*dp* has reached a predetermined amount based on count data of the ON counter of the corresponding one of the second sensors 6*a*-6*d*. Here, the predetermined amount may be an amount of conveyance from the point in time when the leading edge of the sheet P has reached the corresponding one of the second sensing positions 6*ap*-6*dp* to a point in time when the sheet P has been conveyed to a position where a specific position on the sheet P which is defined by image data for recording on the sheet P and onto which the ink is ejected in the first reciprocating operation is opposite the plurality of ejection openings 51*b* of the head 51. Also, the intermittently conveying operation is an operation in which a stopped sheet P is conveyed in the first direction by a predetermined amount (e.g., an amount corresponding to the length of an image, in the first direction, formed in a single reciprocating operation), and then the sheet P is stopped.

The roller pair 53*b* is a one-way roller. That is, rotational power of the roller pair 53*a* is transmitted to the roller pair 53*b*, but rotational power of the roller pair 53*b* is not transmitted to the roller pair 53*a*. Accordingly, while the image-recorded sheet P is successively conveyed toward the sheet receiver 4 by successive drivings of the roller pair 53*b*, the next sheet P can be intermittently conveyed in a corresponding one of the module paths Ra-Rd by intermittent drivings of the roller pair 53*a*. This configuration can improve a throughput. In a configuration in which the roller pair 53*b* is not the one-way roller, but the roller pairs 53*a*, 53*b* are driven in complete synchronization with each other, unlike the present embodiment, when a leading edge of the next sheet P reaches the roller pair 53*a* in the corresponding one of the module paths Ra-Rd before a trailing edge of the sheet P reaches a downstream side of the roller pair 53*b*, the roller pairs 53*a*, 53*b* are both driven intermittently, so that the image-recorded sheet P cannot be successively conveyed toward the sheet receiver 4 by the roller pair 53*a*.

The controller 100 controls operations for flushing and capping which are performed for maintenance of the head 51. The flushing is an operation in which actuators of the head are driven based on flushing data that differs from recording data to forcibly eject ink from the ejection openings 51*b* onto a flushing region 60R (see FIG. 4) provided on a bottom surface of a flushing receiver 60. The flushing region 60R is formed at a position opposite one end of the head movable region 51R. In the flushing, high-viscosity ink and foreign matters (e.g., air bubbles and dust particles) in the ejection openings 51*b* are discharged to recover ejection characteristics. The controller 100 executes control for the flushing during recording (e.g., each completion of reciprocation of the reciprocating operation) and a wait processing which will be described below, for example. The capping is an operation in which the ejection surface 51*a* is covered with a cap 70 (see FIG. 4) to close a space formed opposite the ejection surface 51*a*. In covering the ejection surface 51*a*, the ejection surface 51*a* is opposed to a capping region 70R provided on a bottom surface of the cap 70, and a side wall of the cap 70 is brought into contact with the ejection surface 51*a*. This capping prevents drying in the ejection openings 51*b*. The controller 100 executes control for the capping when no recording command is received for longer or equal to a predetermined length of time, for example.

Figure 7:
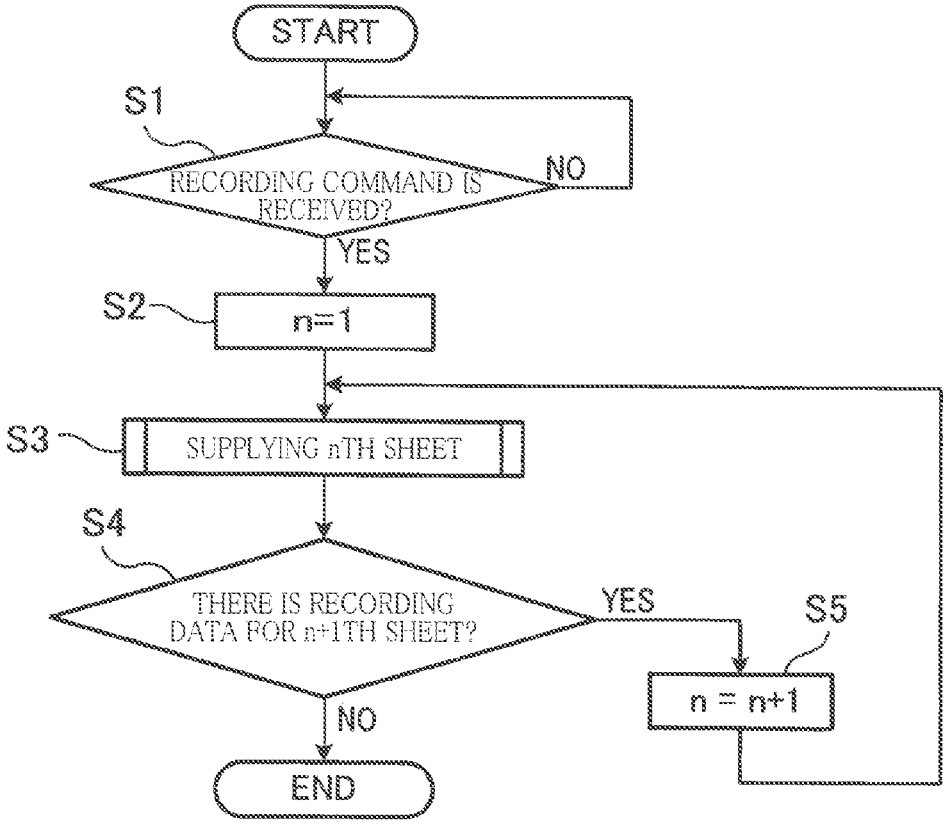
FIG. 7 is a flow chart illustrating processings to be executed by a controller of the printer illustrated in FIG. 1.
Figure 8:
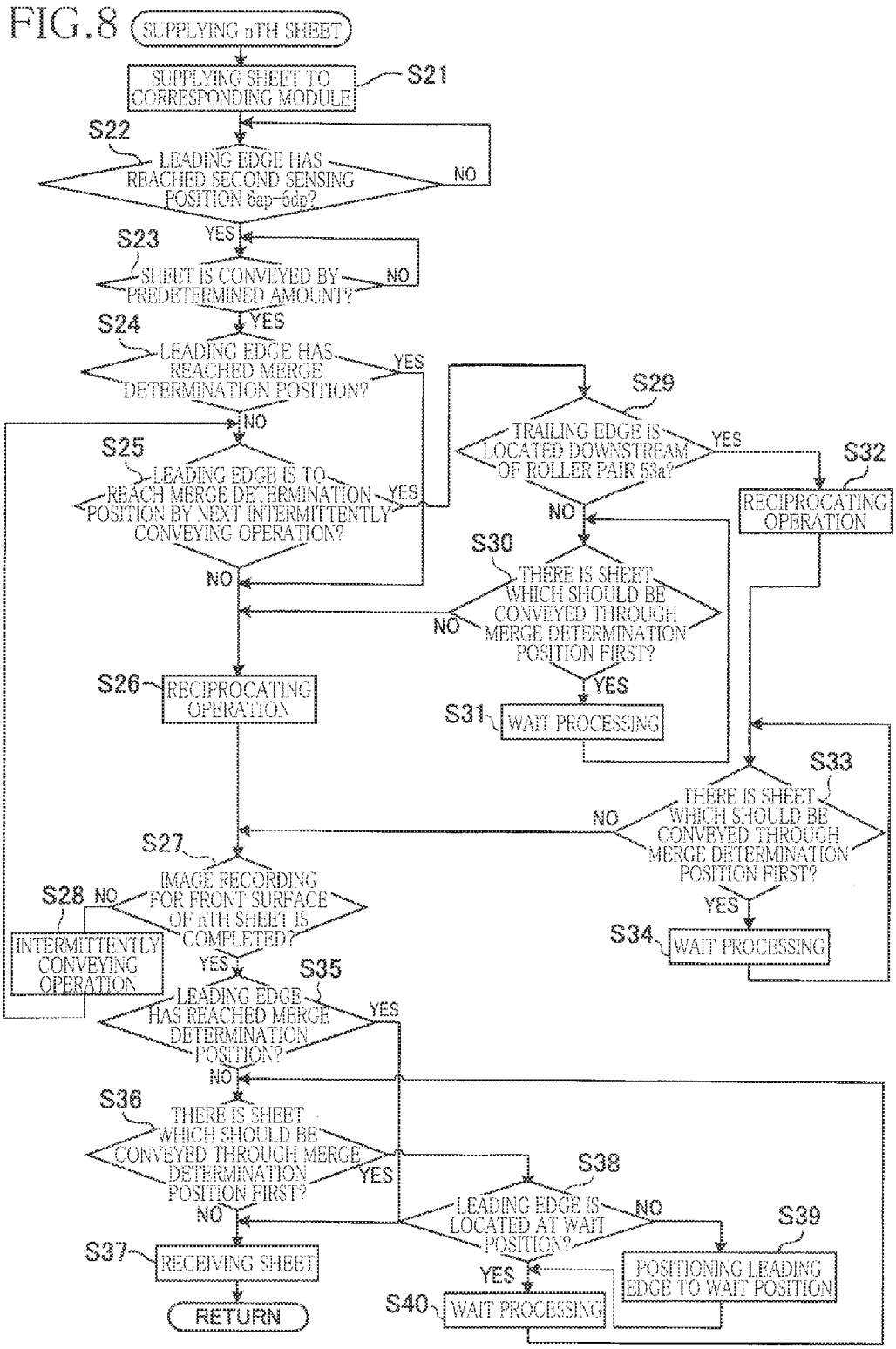
FIG. 8 is a flow chart illustrating a processing at S3 illustrated in FIG. 7.

There will be next explained processings executed by the controller 100 with reference to flow charts in FIGS. 7 and 8.

As illustrated in FIG. 7, this flow begins with S1 at which the controller 100 determines whether a recording command has been received from the external device or not. When the recording command is not received (S1: NO), the controller 100 repeats the processing at S1. When the recording command is received (S1: YES), the controller 100 at S2 sets a variable n to one and at S3 executes a processing for supplying an nth sheet P. The processing at S3 will be described later in detail with reference to FIG. 8. After S3, the controller 100 at S4 determines, based on the recording command received at S1, whether or not there is recording data for an n+1th sheet P or not. When there is no recording data for the n+1th sheet P (S4: NO), this flow ends. When there is recording data for the n+1th sheet P (S4: YES), the controller 100 at S5 sets the variable n to n+1, and this flow returns to S3.

In the processing S3, as illustrated in FIG. 8, the controller 100 at S21 conveys the nth sheet P to a corresponding recording module. The corresponding recording module is one of the four recording modules 50*a*-50*d*. There will be explained which of the recording modules 50*a*-50*d* the corresponding recording module for the nth sheet P corresponds to (i.e., a destination of the supplied sheet P).

Figure 9:
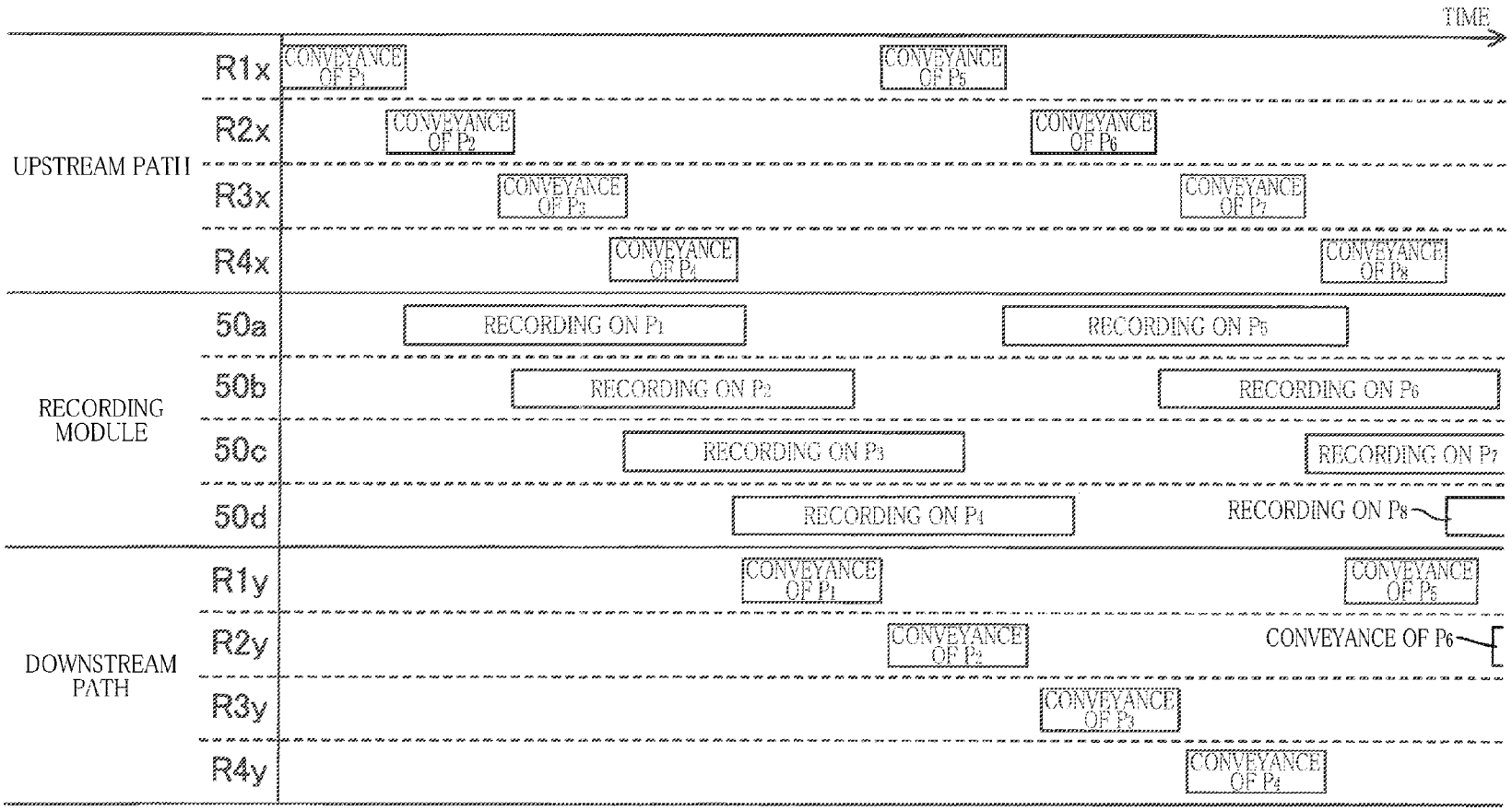
FIG. 9 is a time chart illustrating conveyance and recording in a case where recording is successively performed on a plurality of sheets P having the A4 size or the letter size.
Figure 10:
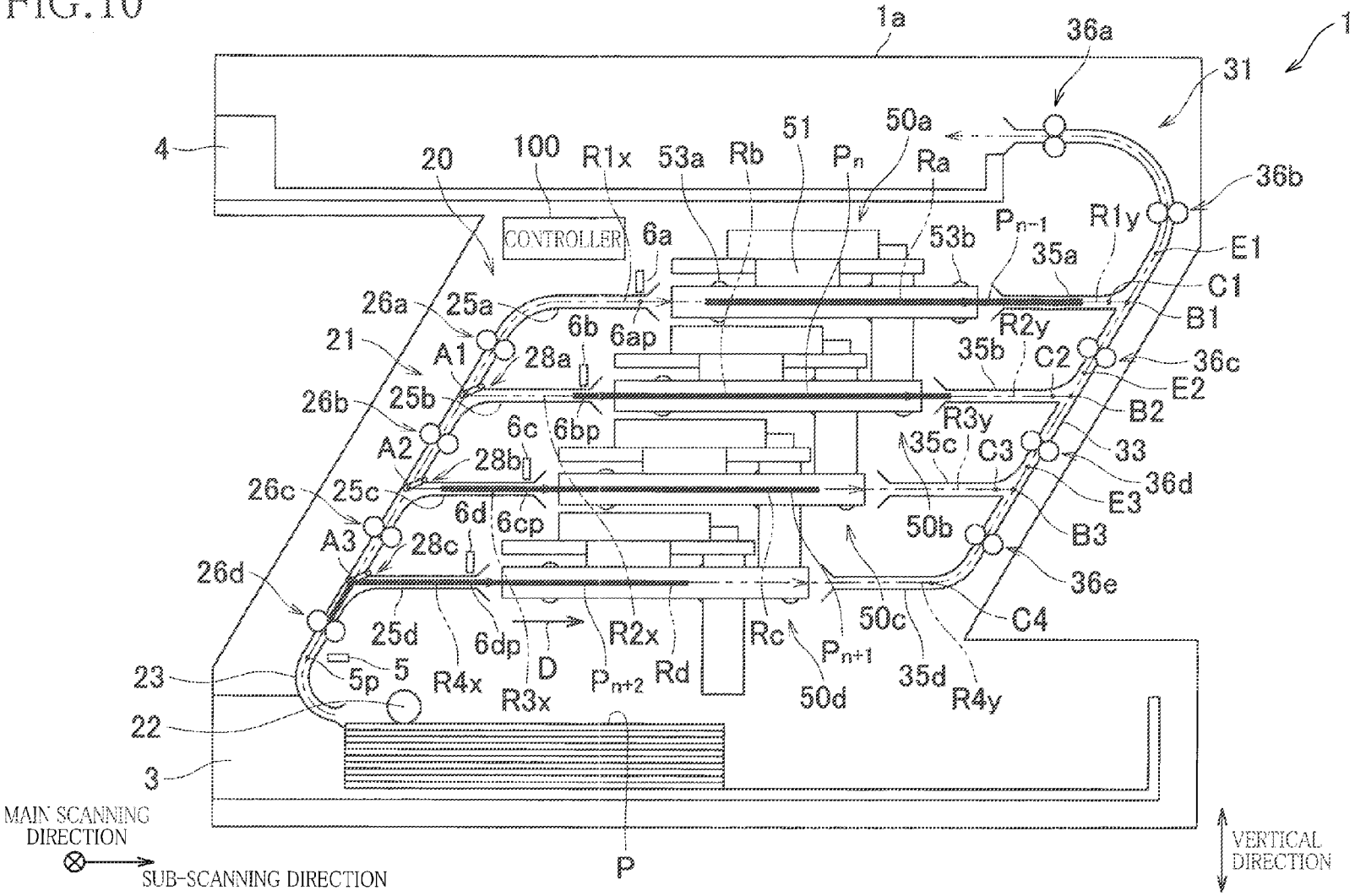
FIG. 10 is a schematic side view, corresponding to FIG. 1, illustrating a situation in which recording is being performed in the recording modules of the printer illustrated in FIG. 1.

In the case where the sheet P is of the A4 size or the letter size, the recording modules 50*a*-50*d* are used in order from the upper module. Specifically, in a case where image recording is successively performed on a plurality of sheets P of the A4 size or the letter size, the first sheet P is supplied to the recording module 50*a*, the second sheet P to the recording module 50*b*, the third sheet P to the recording module 50*c*, and the fourth sheet P to the recording module 50*d*. That is, in the case where the sheet P is of the A4 size or the letter size, the 4m+1th sheet P (n=4m+1 (m is an integer greater than or equal to zero)) is supplied to the uppermost recording module 50*a*, the 4m+2th sheet P (n=4m+2) to the second recording module 50*b* from the top, the 4m+3th sheet P (n=4m+3) to the third recording module 50*c* from the top, and the 4m+4th sheet P (n=4m+4) to the fourth recording module 50*d* from the top. It is noted that the nth sheet (n=1-8) is indicated by "$P_n$" in FIG. 9. In FIG. 10, the n−1th sheet $P_{n-1}$, the nth sheet $P_n$, the n+1th sheet $P_{n+1}$, and the n+2th sheet $P_{n+2}$ are supplied to the recording modules 50*a*-50*d*, respectively.

In the case where the sheet P is of the A3 size, the uppermost recording module 50*a* and the third recording module 50*c* from the top are repeatedly used in this order. Specifically, in a case where image recording is successively performed on a plurality of sheets of the A3 size, the first sheet P is supplied to the recording module 50*a*, the second sheet P to the recording module 50*c*, the third sheet P to the recording module 50*a*, and the fourth sheet P to the recording module 50*c*. That is, in the case where the sheet P is of the A3 size, the 4m+1th or 4m+3th sheet P is supplied to the uppermost recording module 50*a*, and the 4m+2th or 4m+4th sheet P to the third recording module 50*c* from the top.

The recording module to which the sheet P is to be supplied (i.e., the destination of the supplied sheet P) is determined by the controller 100 having referred, after the reception of the recording command (S1: YES), to information contained in the recording command which represents the size and the number of sheets P and referred to a table representing correspondence between a destination of the supply and the size and the number of sheets P. This table is stored in the ROM, for example.

At S21, the controller 100 controls the sheet-supply motor 22M, the upstream conveying motor 26M, and the switching motors 28*a*M-28*c*M to supply the uppermost sheet P stored in the sheet storage 3 as the nth sheet P to the corresponding recording module along a corresponding one of the paths R1$x$-R4$x$.

After S21, the controller 100 at S22 determines whether the leading edge of the nth sheet P has reached one of the second sensing positions 6$ap$-6$dp$ which corresponds to the recording module. When the leading edge has not reached the second sensing position (S22: NO), the controller 100 repeats the processing at S22. When the leading edge has reached the second sensing position (S22: YES), the controller 100 determines whether the nth sheet P has been conveyed by the predetermined amount or not (that is, the controller 100 determines whether the amount of conveyance of the sheet P from the point in time when the leading edge of the sheet P has reached the corresponding one of the second sensing positions 6$ap$-6$dp$ has reached the predetermined conveyance amount or not). The amount of conveyance of the sheet P from the point in time when the leading edge of the sheet P has reached the corresponding one of the second sensing positions 6$ap$-6$dp$ is calculated based on the count data of the ON counter of the corresponding one of the second sensors 6$a$-6$d$. The predetermined conveyance amount is determined based on data representative of an image to be recorded on the sheet P.

When the nth sheet P is not conveyed by the predetermined amount (S23: NO), the controller 100 repeats the processing at S23. When the nth sheet P is conveyed by the predetermined amount (S23: YES), the controller 100 at S24 determines whether the leading edge of the sheet P has reached the corresponding join determination position or not (that is, the controller 100 determines whether the amount of conveyance of the sheet P from the point in time when the leading edge of the sheet P has reached the corresponding one of the second sensing positions 6$ap$-6$dp$ has reached a distance (amount) Lx or not). The corresponding join determination position is one of the join determination positions E1-E3 which is located upstream of the most upstream shared conveyor on a shared portion of a path through which the nth sheet P is to be conveyed to the sheet receiver 4 and a path through which the sheet P different from the nth sheet P is to be conveyed to the sheet receiver 4. For example, in a case where the nth sheet P is supplied to the recording module 50$a$, and the sheet P different from the nth sheet P is supplied to the recording module 50$b$, the most upstream shared conveyor is the roller pair 36$b$, and the corresponding join determination position is the join determination position E1. In a case where the nth sheet P is supplied to the recording module 50$b$, and the sheet P different from the nth sheet P is supplied to the recording module 50$c$, the most upstream shared conveyor is the roller pair 36$c$, and the corresponding join determination position is the join determination position E2. In a case where the nth sheet P is supplied to the recording module 50$c$, and the sheet P different from the nth sheet P is supplied to the recording module 50$d$, the most upstream shared conveyor is the roller pair 36$d$, and the corresponding join determination position is the join determination position E3. In a case where the nth sheet P is supplied to the recording module 50$d$, and the sheet P different from the nth sheet P is supplied to the recording module 50$a$, the most upstream shared conveyor is the roller pair 36$b$, and the corresponding join determination position is the join determination position E1. The distance Lx is a distance along the corresponding path between the corresponding one of the second sensing positions 6$ap$-6$dp$ to the corresponding join determination position. FIG. 1 illustrates, as the distance Lx, a distance along the paths R1$x$, Ra, R1$y$ between the second sensing position 6$ap$ and the join determination position E1.

When the leading edge has reached the corresponding join determination position (S24: YES), this flow goes to S26. When the leading edge has not reached the corresponding join determination position (S24: NO), the controller 100 at S25 determines whether the leading edge of the sheet P is to reach the corresponding join determination position or not in the case where the next intermittently conveying operation is performed on the nth sheet P.

When the leading edge of the sheet P is not to reach the corresponding join determination position in the case where the next intermittently conveying operation is performed on the nth sheet P (S25: NO), the controller 100 at S26 controls the head 51 and the carriage motor 52M of the corresponding one of the recording modules 50$a$-50$d$ to perform the reciprocating operation.

After S26, the controller 100 at S27 determines whether image recording for a front surface of the nth sheet P is completed or not. It is noted that the front surface of the nth sheet P faces downward in the sheet storage 3 and faces the head 51 during image recording. When the image recording is not completed (S27: NO), the controller 100 at S28 controls the individual conveying motor 53M of the corresponding one of the recording modules 50$a$-50$d$ to perform the intermittently conveying operation. Upon completion of the processing at S28, this flow returns to S25.

When the leading edge of the sheet P is to reach the corresponding join determination position in the case where the next intermittently conveying operation is performed on the nth sheet P (S25: YES), the controller 100 at S29 determines whether the trailing edge of the sheet P is located downstream of the roller pair 53$a$ on the module path of the recording module or not, that is, the controller 100 determines whether an amount of conveyance of the sheet P from a point in time when the trailing edge of the sheet P has reached the corresponding one of the second sensing positions 6$ap$-6$dp$ has reached a distance (amount) Ly or not. The amount of conveyance of the sheet P from the point in time when the trailing edge of the sheet P has reached the corresponding one of the second sensing positions 6$ap$-6$dp$ is calculated based on count data of the OFF counter of the corresponding one of the second sensors 6$a$-6$d$. The distance Ly is a distance along the corresponding path between the corresponding one of the second sensing positions 6$ap$-6$dp$ and the roller pair 53$a$ of the corresponding recording module (i.e., a contacting position of the two rollers of the roller pair 53$a$). FIG. 1 illustrates, as the distance Ly, a distance along the path R1$x$ between the second sensing position 6$ap$ and the roller pair 53$a$ of the recording module 50$a$.

When the trailing edge of the nth sheet P is not located downstream of the roller pair 53$a$ on the module path of the recording module (S29: NO), the controller 100 at S30 determines whether or not there is a sheet P which should be conveyed through the corresponding one of the join determination positions E1-E3 before the nth sheet P. In the case where the nth sheet P is supplied to the recording module 50$b$, for example, this determination includes: determination of whether a sheet P supplied to the recording module 50$a$ is to pass through the join determination position E1 before the nth sheet P; determination of whether a sheet P supplied to the recording module 50$c$ is to pass through the join determination position E2 before the nth sheet P; and determination of whether a sheet P supplied to the recording module 50$d$ is to pass through the join determination position E2 before the nth sheet P.

When there is a sheet P which should be conveyed through the corresponding one of the join determination positions E1-E3 before the nth sheet P (S30: YES), the controller 100 at S31 executes the wait processing.

In the wait processing, the controller controls the recording module to keep the nth sheet P waiting in a state in which its leading edge is located upstream of the most upstream shared conveyor on the corresponding path. In a case where the head 51 is located at a position other than a position opposite the flushing region 60R (see FIG. 4) just before the wait processing, the controller 100 controls the carriage motor 52M to move the head 51 to the position opposite the flushing region 60R. Also, the controller 100 keeps the head 51 at the position opposite the flushing region 60R during the wait processing.

Upon completion of the wait processing at S31, this flow returns to S30. When there is no sheet P which should be conveyed through the corresponding one of the join determination positions E1-E3 before the nth sheet P (S30: NO), this flow goes to S26.

When the trailing edge of the nth sheet P is located downstream of the roller pair 53*a* on the module path of the recording module (S29: YES), the controller 100 at S32 executes the reciprocating operation as in the processing at S26.

Upon completion of the processing at S32, as in the processing at S30, the controller 100 at S33 determines whether or not there is a sheet P which should be conveyed through the corresponding one of the join determination positions E1-E3 before the nth sheet P. When there is a sheet P which should be conveyed through the corresponding one of the join determination positions E1-E3 before the nth sheet P (S33: YES), the controller 100 at S34 executes the wait processing as in the processing at S31.

Upon completion of the wait processing at S34, this flow returns to S33. When there is no sheet P which should be conveyed through the corresponding one of the join determination positions E1-E3 before the nth sheet P (S33: NO), this flow goes to S27.

When the image recording is completed for the front surface of the nth sheet P (S27: YES), the controller 100 at S35 determines whether the leading edge of the sheet P has reached the corresponding join determination position or not as in the processing at S24. When the leading edge has reached the corresponding join determination position (S35: YES), this flow goes to S37. When the leading edge has not reached the corresponding join determination position (S35: NO), the controller 100 at S36 determines whether or not there is a sheet P which should be conveyed through the corresponding one of the join determination positions E1-E3 before the nth sheet P, as in the processings at S30 and S33. When there is no sheet P which should be conveyed through the corresponding one of the join determination positions E1-E3 before the nth sheet P (S36: NO), the controller 100 at S37 controls the downstream conveying motor 36M to convey the nth sheet P along any of the paths R1*y*-R4*y* and output the nth sheet P onto the sheet receiver 4, and this flow (at S3) ends.

When there is a sheet P which should be conveyed through the corresponding one of the join determination positions E1-E3 before the nth sheet P (S36: YES), the controller 100 at S38 determines whether the leading edge of the nth sheet P is located at a corresponding one of wait positions C1-C4 or not (that is, the controller 100 determines whether the amount of conveyance of the sheet P from the point in time when the leading edge of the sheet P has reached the corresponding one of the second sensing positions 6*ap*-6*dp* has reached a distance (amount) Lz or not). The distance Lz is a distance along the corresponding path between the corresponding one of the second sensing positions 6*ap*-6*dp* and the corresponding one of the wait positions C1-C4. FIG. 1 illustrates, as the distance Lz, a distance along the paths R1*x*, Ra, R1*y* between the second sensing position 6*ap* and the wait position C1.

As illustrated in FIG. 1, each of the wait positions C1-C4 is located upstream of the most upstream one of the joining positions on a corresponding one of the paths R1*y*-R4*y*. The wait position C1 is located just upstream of the joining position B1 on the path R1*y*. The wait position C2 is located just upstream of the joining position B2 on the path R2*y*. The wait position C3 is located just upstream of the joining position B3 on the path R3*y*. The wait position C4 is located upstream of the joining position B3 on the path R4*y*. Each of the wait positions C1-C4 is located at a horizontally extending portion of the corresponding one of the paths R1*y*-R4*y* (noted that the horizontally extending portion exists on the same plane as the corresponding one of the module paths Ra-Rd). The wordings "corresponding wait position" is one of the wait positions C1-C4 which is determined for a corresponding one of the paths R1*y*-R4*y* through which the nth sheet P is to be conveyed.

When the leading edge of the nth sheet P is not located at the corresponding one of the wait positions C1-C4 (S38: NO), the controller 100 at S39 controls the individual conveying motor 53M of the corresponding one of the recording modules 50*a*-50*d* to convey the nth sheet P in the direction D to position the leading edge of the sheet P to the corresponding wait position. Upon completion of the processing at S39, this flow goes to S40. When the leading edge of the nth sheet P is located at the corresponding wait position (S38: YES), the controller 100 at S40 executes the wait processing as in the processings at S31 and S34, and this flow returns to S36.

In the case where the sheet P is of the A4 size or the letter size, when the leading edge of the sheet P is located at the corresponding one of the wait positions C1-C4, the sheet P faces the ejection surface 51*a*, and the trailing edge of the sheet P is located downstream of the most downstream one of the branch positions A1-A3 on the corresponding one of the paths R1*x*-R4*x*.

In the present embodiment, each of the processings at S30, S33, and S36 is one example of a first determination processing, the processing at S25 is one example of a second determination processing, the processing at S29 is one example of a third determination processing, the processing at S28 is one example of the intermittently conveying operation, each of the processings at S26 and S32 is one example of the reciprocating operation, each of the processings at S31, S34, and S40 is one example of the wait processing, and the processing at S39 is one example of a positioning processing.

In the present embodiment as described above, the first path and the module path of the first recording module (e.g., the path R1*y* and the module path Ra) are formed, as illustrated in FIG. 1, such that the distance L along the first path and the module path between (i) the position Q opposite the most downstream one of the multiplicity of ejection openings 51*b* (see FIG. 3) of the first recording module (e.g., the recording module 50*a*) and (ii) the joining position (e.g., the joining position B1) is shorter than the length of the sheet P of the A4 size or the letter size. This construction can shorten the first path, leading to reduced size of the printer 1.

The controller 100 controls the recording modules 50*a*-50*d* to perform the intermittently conveying operation (S28) and the reciprocating operation (S26 and S32). This construction can reduce the size of the serial printer 1 configured to intermittently convey the sheet P.

When the leading edge of the sheet P is to reach the corresponding join determination position in the case where the next intermittently conveying operation is performed on the nth sheet P (S25: YES), the controller 100 executes at S31 and S34 controls the corresponding recording module to execute the wait processing without executing the next intermittently conveying operation at S28. In particular, the above-described control of the serial printer 1 can reduce the size of the printer 1 and prevent an occurrence of a sheet jam in the shared portion of the paths.

When the trailing edge of the nth sheet P is located downstream of the roller pair 53*a* on the module path of the recording module (S29: YES), the controller 100 at S32 executes the reciprocating operation and at S34 executes the wait processing. When comparing a configuration where the wait processing is executed before the recording by the reciprocating processing when the trailing edge of the nth sheet P is located downstream of the roller pair 53*a* on the module path of the recording module and a configuration where the wait processing is executed after the recording by the reciprocating processing when the trailing edge of the nth sheet P is located downstream of the roller pair 53*a* on the module path of the recording module, the recording quality is deteriorated more easily in the former configuration than in the latter configuration. One reason is that since, for example, the sheet P is deformed by absorbing the ink, and a trailing edge portion of the sheet P is free without being nipped by the roller pairs, the ink landed portion of the sheet P is further deformed during waiting such that the trailing edge portion is deformed toward the head 51, which may change a distance between the head 51 and the sheet P. The change in the distance may deteriorate the accuracy of landing of ink, leading to lower recording quality. Another reason is that the length of time required for the ink to soak into the sheet P differs between the image recorded before waiting and the image recorded after waiting, for example, which may cause positional difference between the images. Since this printer 1 employs the latter configuration, it is possible to reduce an amount of deterioration of the recording quality.

The specific recording medium is the A4 size. With this configuration, the size of the printer 1 can be reduced when using the sheet P of the A4 size as a widely used size in particular.

The specific recording medium is the letter size. With this configuration, the size of the printer 1 can be reduced when using the sheet P of the letter size as a widely used size in particular.

When the trailing edge of the nth sheet P is not located downstream of the roller pair 53*a* on the module path of the recording module (S29: NO), the controller 100 controls the corresponding recording module to execute the wait processing at S31 without executing the reciprocating operation at S32. When comparing a configuration where the wait processing is executed after the reciprocating operation when the trailing edge of the nth sheet P is not located downstream of the roller pair 53*a* on the module path of the recording module and a configuration where the wait processing is executed without execution of the reciprocating operation when the trailing edge of the nth sheet P is not located downstream of the roller pair 53*a* on the module path of the recording module, the recording quality is deteriorated more easily in the former configuration than in the latter configuration. One reason is that the former configuration has a problem that a portion of the sheet P which is located downstream of the roller pair 53*a* and on which the ink has landed by the reciprocating operation performed before the wait processing deforms easily during the wait processing. Since an upper surface of a portion of the sheet P which is opposite the head 51 cannot be pressed by a roller or a rib, a holding force is lower than at the other portion of the sheet P, so that the portion of the sheet P is easily deformed. Since this printer 1 employs the latter case, the sheet P can be kept waiting in a state in which the ink landed portion of the sheet P is not easily deformed, making it possible to reduce the amount of deterioration of the recording quality.

Upon completion of the wait processing at S31, the controller 100 controls the corresponding recording module to execute the reciprocating operation at S26. This configuration allows the recording to be restarted by the reciprocating operation after the wait processing.

The sheet receiver 4 can receive the sheet P of the A3 size. This construction can reduce the size of the printer 1 and reduce the amount of deterioration of the recording quality in the case where the sheet P of the A3 size is used.

When there is a sheet P which should be conveyed through the corresponding one of the join determination positions E1-E3 before the nth sheet P (S36: YES) and when the recording on the front surface of the nth sheet P is completed (S27: YES), the controller 100 at S39 executes the positioning processing before the wait processing at S40. In FIG. 10, for example, the n−1th sheet $P_{n-1}$ should pass through the join determination position E1 before the nth sheet $P_n$, but in a case where the recording on the front surface of the nth sheet $P_n$ is completed before the recording on the front surface of the n−1th sheet $P_{n-1}$, the positioning processing at S39 for positioning the leading edge of the nth sheet $P_n$ to the wait position C2 is executed before the wait processing at S40. As a result, the trailing edge of the nth sheet P, is located downstream of the branch position A1. With this configuration, the leading edge of the nth sheet $P_n$ is positioned at the corresponding one of the wait positions C1-C4, and thereby the length of a portion of the trailing edge portion of the nth sheet $P_n$ which exists in a sheet supply path can be shortened, allowing prompt supply of the n+1th sheet $P_{n+1}$. In addition, positioning the leading edge of the sheet P at the corresponding one of the wait positions C1-C4 makes it possible for the sheet receiver 4 to promptly receive the sheet P, leading to improved throughput.

When executing the wait processing at S31, S34, and S40, the controller 100 controls the head 51 to wait at the position opposite the flushing region 60R (see FIG. 4). With this configuration, the flushing can be performed during waiting, resulting in reduced time required for the maintenance.

The controller 100 recognizes the position of the sheet P on the corresponding one of the paths R1*y*-R4*y* and executes the processings at S25 and S29 based on the result of this recognition, resulting in reliable execution of the processings at S25 and S29.

The controller 100 recognizes the position of the sheet P on the corresponding one of the paths R1*y*-R4*y*, based on the signal output from the corresponding one of second sensors 6*a*-6*d*, resulting in more accurate execution of the processings at S25 and S29.

The join determination position E1 is determined on the shared portion of the paths R1*y*, R2*y* at the position between the joining position B1 and the roller pair 36*b*. The join determination position E2 is determined on the shared portion of the paths R2*y*, R3*y* at the position between the joining position B2 and the roller pair 36*c*. The join determination position E3 is determined on the shared portion of the paths R3*y*, R4*y* at the position between the joining position B3 and the roller pair 36*d*. This configuration can improve throughput while preventing a sheet jam.

Figure 11:
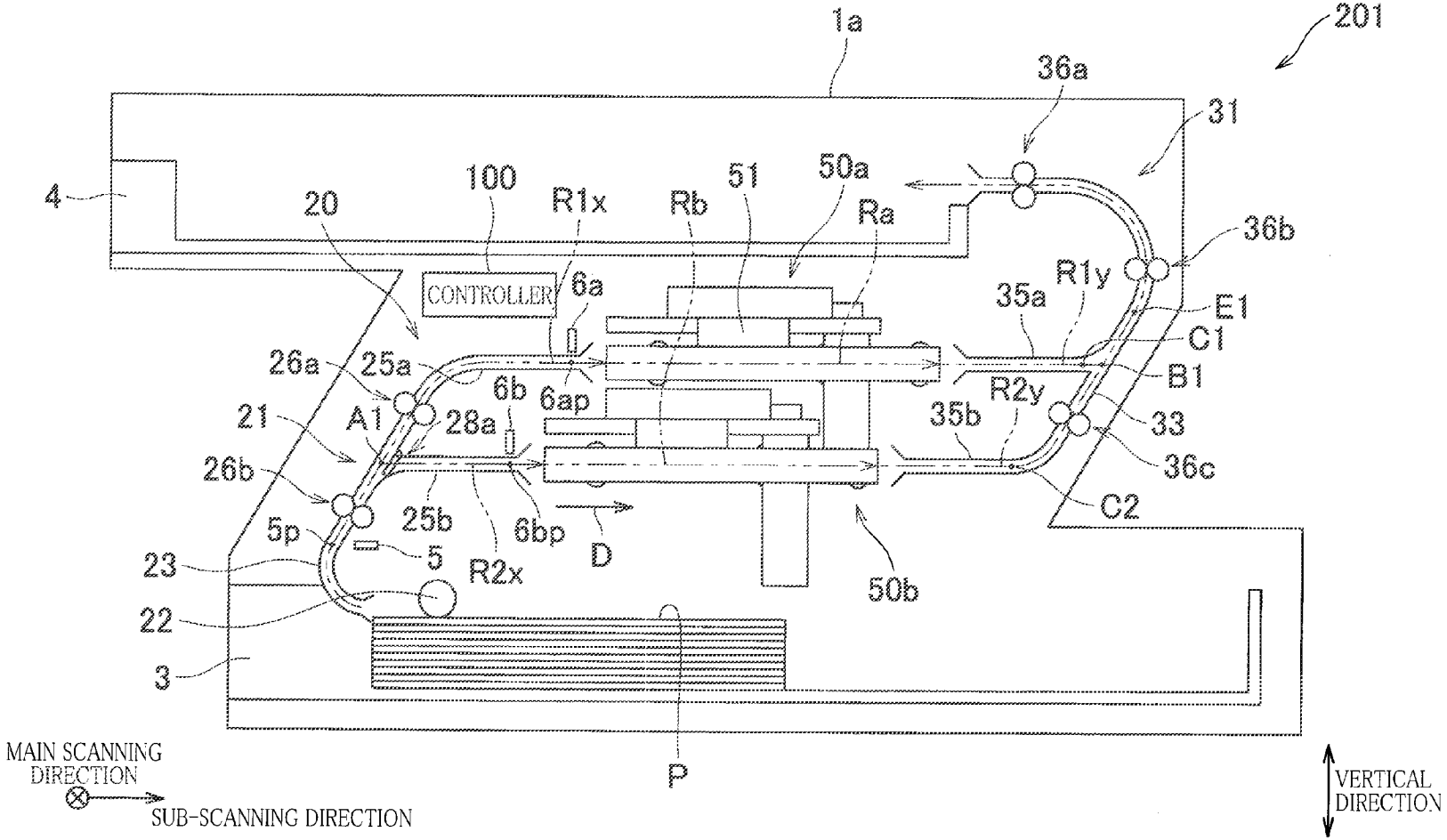
FIG. 11 is a schematic side view, corresponding to FIG. 1, illustrating an internal structure of an ink-jet printer according to a second embodiment of the present invention.

There will be next explained an ink-jet printer 201 according to a second embodiment of the present invention with reference to FIG. 11.

The printer 201 according to the second embodiment has the same construction as the printer 1 according to the first embodiment except for the number of recording modules and a construction of paths. It is noted that the same reference numerals as used in the first embodiment are used to designate the corresponding elements of the second embodiment, and an explanation of which is dispensed with.

The printer 201 includes two recording modules 50*a*, 50*b*. Two cartridges, not shown, are mountable on and removable from the housing 1*a*. The upstream unit 21 has two paths R1*x*, R2*x* through which the sheet P is conveyed from the sheet storage 3 to the respective module paths Ra, Rb formed in the respective recording modules 50*a*, 50*b*. The downstream unit 31 has two paths R1*y*, R2*y* through which the sheet P is conveyed from the downstream end portions of the respective module paths Ra, Rb to the sheet receiver 4.

Also in the second embodiment, the same construction as employed in the first embodiment can achieve the same effects as obtained in the first embodiment.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The number of recording modules may be any number as long as a plurality of recording modules are provided. The recording modules are used in order from above in the above-described embodiment, but the present invention is not limited to this configuration. For example, the recording modules may be used in order from below and may be used in other orders.

The positional relationship between the recording modules is not limited in particular. For example, while the four recording modules 50*a*-50*d* are arranged at different positions in the sub-scanning direction in the above-described embodiment, the recording modules may be arranged without difference in positions in the sub-scanning direction, that is, the recording modules may be arranged at the same position in the sub-scanning direction. Two recording modules adjacent to each other in the vertical direction may be arranged at different positions in a direction, in the plane of the module paths, which differs from the sub-scanning direction (e.g., the main scanning direction). The plurality of recording modules may not be arranged in the vertical direction, and the plurality of recording modules may be arranged in the horizontal direction and may not be arranged in one direction.

Recording modules assumed to be the first recording module and the second recording module among the plurality of recording modules may be changed as needed according to, e.g., the construction of the paths. For example, the recording module 50*a* may be assumed as the first recording module, and the recording module 50*c* as the second recording module.

Another recording module may be disposed between the first recording module and the second recording module. The plurality of recording modules may have different constructions. For example, the plurality of recording modules may be different from each other in, e.g., recordable color, resolution, recording speed, recording method, type of recordable recording medium, and size of recordable recording medium.

The plurality of roller pairs constituting the individual conveyor may be driven by the same drive source and may be driven respectively by individual drive sources. In the above-described embodiment, the roller pair 53*b* may not be the one-way roller, and the roller pairs 53*a*, 53*b* may be driven in complete synchronization with each other.

The intersecting angle of a plurality of paths and the angle of a curved portion of one path may be any angles. For example, the guide 23 and each of the guides 25*a*-25*d* are not perpendicular to each other in the above-described embodiment but may be perpendicular to each other. Likewise, the guide 33 and each of the guides 35*a*-35*d* are not perpendicular to each other in the above-described embodiment but may be perpendicular to each other.

Relationship of position, angle, and so on between the plurality of paths may be any relationship. In the above-described embodiment, for example, the angles of the guide 23, 33 with respect to the vertical direction may or may not be the same as each other. The number of paths and the construction of each path may be changed according to the number and/or arrangement of recording modules.

The plurality of pivot members constituting the switcher may be driven by the same drive source and may be driven respectively by individual drive sources. The switcher may not include the pivot members used in the above-described embodiment. For example, the switcher may be configured to switch the path by applying an external force to the recording medium by, e.g., an electrostatic force or air without contacting the recording medium.

Each of the first sensor and the second sensor may be any type of sensor such as an optical sensor, a mechanical sensor, and a magnetic sensor. Each of the first and second sensing positions may be determined at any position on any one of (i) a path through which the recording medium is conveyed from the sheet storage to the module path of the corresponding recording module, (ii) the module path of each recording module, and (iii) a path through which the recording medium is conveyed from the module path of each recording module to the sheet receiver. For example, the first sensing position may be determined on the path R1*x* between the branch positions A2, A3 or between the branch positions A1, A2 and may be located at any of the branch positions A1, A2, A3. Each of the first sensor and the second sensor is not essential for the present invention, and any or both of the first sensor and the second sensor may be omitted.

A calculating method in each determination may be changed as needed. For example, in a case where each of the second sensing positions 6*ap*-6*dp* is located at the corresponding join determination position, a distance between each of the second sensing positions 6*ap*-6*dp* and the corresponding join determination position is zero. In this case, accordingly, the controller may determine, without calculating the conveyance amount, that the leading edge of the nth sheet P has reached the corresponding join determination position (S24: YES), at a point in time when the leading edge of the nth sheet P has reached the corresponding one of the second sensing positions 6*ap*-6*dp*.

The wait position may be located at any position on an upstream side of the most upstream shared conveyor on the first path. The controller does not need to position the leading edge of the recording medium to the wait position in the wait processing. The controller only has to position the leading edge of the recording medium to any position located on an upstream side of the most upstream shared conveyor on the first path. For example, the leading edge of the recording medium may be located downstream of the join determination position in the wait processing. The controller may not execute the positioning processing. The controller may not execute the reciprocating operation after the wait processing.

The join determination position is not limited to a position defined between the joining position and the most upstream shared conveyor on the shared portion as long as the join determination position is determined upstream of the most upstream shared conveyor. For example, the join determination position may be located at the joining position and may be located upstream of the joining position. The second determination processing, the third determination processing, and processings based on these determination processings may be omitted.

The flushing may be performed at any timing. For example, the flushing may be performed at each reciprocating operation, each elapse of a predetermined time (e.g., several seconds), or each completion of recording on a predetermined number of sheet surfaces, for example. Also, the flushing may or may not be performed during the wait processing. In a case where the wait processing is executed, the head may not wait at the position opposite the flushing region. The flushing region may be determined at any position and may be omitted.

A higher priority may be given to any of the plurality of paths for conveyance of the recording medium. The controller may determine, at any timing, combination of the recording media and paths to which the recording media are to be conveyed. The timing is not limited to a point in time between the reception of the recording command and the start of the conveyance of the recording medium and may be a point in time after the recording operation is started (e.g., a point in time after a start of conveyance of the preceding recording medium or a point in time between the start of conveyance of the recording medium and a start of operation of the switcher). Recording may be performed on a first surface of the recording medium and a second surface of the recording medium which is a back side from the first surface (e.g., a front surface and a back surface of the sheet P).

The size of the specific recording medium is not limited to the A4 size or the letter size and may be the A3 size, the postcard size, the A6 size, or the like. The recording medium is not limited to the sheet and may be any recording medium.

Each of the sheet storage and the sheet receiver may be disposed any position. For example, the sheet receiver may be disposed at a position at which only a part of the plurality of recording modules is interposed between the sheet receiver and the sheet storage in a direction of the arrangement of the recording modules. The sheet storage and the sheet receiver may be disposed on the same side of the plurality of recording modules. The sheet storage and/or the sheet receiver may be disposed at a position not overlapping any of the recording modules in the direction of the arrangement of the recording modules.

A recording-medium support surface of the sheet storage and/or the sheet receiver may be inclined with respect to the horizontal direction. The sheet receiver may be configured not to receive the recording medium of the A3 size.

The present invention is applicable not only to the serial printer but also to a line printer. The present invention is applicable not only to the printer but also to other devices such as a facsimile machine and a copying machine.

What is claimed is:

1. A recording apparatus, comprising:

a plurality of recording modules each comprising (i) a head formed with a plurality of ejection openings and configured to eject liquid from the plurality of ejection openings and (ii) an individual conveyor configured to convey a recording medium along a module path, the plurality of recording modules comprising a first recording module and a second recording module different from the first recording module;

a receiver configured to receive the recording medium on which recording is performed by any one of the plurality of recording modules;

a first path through which the recording medium is to be conveyed from the module path of the first recording module toward the receiver;

a second path through which the recording medium is to be conveyed from the module path of the second recording module toward the receiver, the second path comprising, at a downstream portion thereof, a shared portion extending to the receiver from a joining position at which the first path and the second path merge with each other;

at least one shared conveyor configured to convey the recording medium in the shared portion; and a controller configured to control the plurality of recording modules, the controller being configured to store information about a join determination position located upstream of a most upstream shared conveyor of the at least one shared conveyor, the first path and the module path of the first recording module being formed such that a distance between a position opposite a most downstream one of the plurality of ejection openings formed in the first recording module and the joining position along the first path and the module path of the first recording module is less than a length of a specific recording medium along the module path of the first recording module, the specific recording medium being one of recording media receivable in the receiver, the controller being configured to:

execute a first determination processing in which the controller determines whether there is a recording medium which should be conveyed through the join determination position before the recording medium having been supplied to the first recording module; and execute a wait processing in which the controller causes the recording medium having been supplied to the first recording module to wait in a state in which the leading edge of the recording medium is located on the first path at a position located upstream of the most upstream shared conveyor, when the controller determines, in the first determination processing, that there is a recording medium which should be conveyed through the join determination position before the recording medium having been supplied to the first recording module, wherein each of the plurality of recording modules comprises a carriage supporting the head and configured to move the head in a first direction, wherein the individual conveyor is configured to intermittently convey the recording medium in a second direction perpendicular to the first direction, and wherein the controller is configured to execute (i) an intermittently conveying operation in which the controller controls the individual conveyor to intermittently convey the recording medium in the second direction and (ii) a reciprocating operation in which the controller controls the head to eject the liquid from the plurality of ejection openings while controlling the carriage to move in the first direction in a conveyance stopped period in which conveyance of the recording medium is stopped, the conveyance stopped period being provided between two successive intermittently conveying operations, wherein the controller is configured to execute a second determination processing in which before executing a next intermittently conveying operation for the recording medium having been supplied to the first recording module, the controller determines whether the leading edge of the recording medium is to reach the join determination position by the next intermittently conveying operation, and wherein the controller is configured to control the first recording module not to execute the next intermittently conveying operation but to execute the wait processing, when the controller determines, in the second determination processing, that the leading edge of the recording medium is to reach the join determination position.

2. The recording apparatus according to claim 1, wherein the individual conveyor comprises a roller pair disposed upstream of the head on the module path, and wherein the controller is configured to:

execute a third determination processing in which the controller determines whether a trailing edge of the recording medium having been supplied to the first recording module is located downstream of the roller pair on the module path of the first recording module; and control the first recording module to execute the reciprocating operation and thereafter execute the wait processing, when the controller determines, in the third determination processing, that the trailing edge of the recording medium is located downstream of the roller pair on the module path of the first recording module.

3. The recording apparatus according to claim 1, wherein the specific recording medium is of an A4 size.

4. The recording apparatus according to claim 1, wherein the specific recording medium is of a letter size.

5. The recording apparatus according to claim 2, wherein the controller is configured to control the first recording module to execute the wait processing without executing the reciprocating operation, when the controller determines, in the third determination processing, that the trailing edge of the recording medium is not located downstream of the roller pair on the module path of the first recording module.

6. The recording apparatus according to claim 5, wherein the controller is configured to execute the wait processing and thereafter control the first recording module to execute the reciprocating operation.

7. The recording apparatus according to claim 5, wherein the receiver is capable of receiving a recording medium of an A3 size.

8. The recording apparatus according to claim 1, wherein the controller is configured to:

execute a fourth determination processing in which the controller determines whether recording is completed for a surface of the recording medium having been supplied to the first recording module, which surface faces the head; and execute, before the wait processing, a positioning processing in which the controller controls the first recording module to position the leading edge of the recording medium having been supplied to the first recording module, to a wait position located upstream of the most upstream shared conveyor on the first path, when the controller determines, in the first determination processing, that there is a recording medium which should be conveyed through the join determination position before the recording medium having been supplied to the first recording module and when the controller determines, in the fourth determination processing, that recording is completed for the surface of the recording medium which faces the head.

9. The recording apparatus according to claim 1, wherein the controller is configured to, in the wait processing, control the head to wait at a position opposite a flushing region that is defined at a position opposite an end portion of a region within which the head is movable.

10. The recording apparatus according to claim 1, wherein the controller is configured to recognize a position of the recording medium on the first path and execute the second determination processing based on the position recognized by the controller.

11. The recording apparatus according to claim 2, wherein the controller is configured to recognize a position of the recording medium on the first path and execute the third determination processing based on the position recognized by the controller.

12. The recording apparatus according to claim 10, further comprising a sensor configured to output a signal indicating presence or absence of the recording medium, wherein the controller is configured to recognize the position of the recording medium on the first path based on the signal output from the sensor.

13. The recording apparatus according to claim 1, wherein the join determination position is located on the shared portion at a position between the joining position and the most upstream shared conveyor.

* * * * *